US009701136B2

(12) United States Patent
Pohlt

(10) Patent No.: US 9,701,136 B2
(45) Date of Patent: Jul. 11, 2017

(54) METHOD AND DEVICE FOR PRINTING WITH TEMPERATURE GRADIENT FOR OPTIMAL SOLVENT PENETRATION

(71) Applicant: Oce Printing Systems GmbH & Co. KG, Poing (DE)

(72) Inventor: Michael Pohlt, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/995,491

(22) Filed: Jan. 14, 2016

(65) Prior Publication Data

US 2016/0207331 A1 Jul. 21, 2016

(30) Foreign Application Priority Data

Jan. 15, 2015 (DE) ..... 10 2015 100 535

(51) Int. Cl.
*B41M 7/00* (2006.01)
*B41M 5/00* (2006.01)
*B41J 11/00* (2006.01)

(52) U.S. Cl.
CPC ..... *B41J 11/002* (2013.01); *B41J 11/0015* (2013.01); *B41M 5/0023* (2013.01); *B41M 7/009* (2013.01)

(58) Field of Classification Search
CPC .... B41J 2/2107; B41J 11/0015; B41J 11/002; C09D 11/322; B41M 5/0011; B41M 5/0023; B41M 5/0047; B41M 5/508; B41M 7/00; B41M 7/009; B41M 5/0017
See application file for complete search history.

(56) References Cited

U.S. PATENT DOCUMENTS

| | | | | |
|---|---|---|---|---|
| 7,364,266 | B2 * | 4/2008 | Konno | B41J 2/2114 347/15 |
| 7,628,481 | B2 * | 12/2009 | Kadomatsu | B41J 2/2114 347/101 |
| 8,162,423 | B2 * | 4/2012 | Chiwata | B41J 11/0015 347/6 |
| 8,186,820 | B2 * | 5/2012 | Chiwata | B41J 11/002 106/31.13 |
| 8,733,881 | B2 * | 5/2014 | Kobayashi | B41M 5/00 347/102 |
| 2004/0189762 | A1 | 9/2004 | Chen et al. | |
| 2014/0015907 | A1 | 1/2014 | Takemoto | |

OTHER PUBLICATIONS

German Patent Office, Office Action issued for DE 10 2015 100 535.2, 6 pgs., dated Oct. 13, 2015.

* cited by examiner

*Primary Examiner* — Anh T. N. Vo
(74) *Attorney, Agent, or Firm* — Schiff Hardin LLP

(57) ABSTRACT

A method for printing to a recording medium having at least one ink or at least one liquid toner whose liquid component includes a plurality of fluids, wherein after the printing, the method includes heat treating the recording medium in a range from 40 to 80° C.; and fixing the recording medium at a temperature of at least 90° C.

23 Claims, 8 Drawing Sheets

METHOD AND DEVICE FOR PRINTING WITH TEMPERATURE GRADIENT FOR OPTIMAL SOLVENT PENETRATION

FIELD OF THE DISCLOSURE

The present disclosure concerns a method for printing to a recording medium with at least one ink or at least one liquid toner which or, respectively, whose liquid component has multiple liquids, as well as a printing device for implementation of the method.

BACKGROUND

In inkjet printing, printing typically occurs with liquid ink that is typically comprised of multiple components. The water and solvent are often for example glycol. These solvents often have high boiling points in a range from 200° C. to 300° C. This ink fluid is customarily applied by nozzles to the paper surface. The ink is often subsequently dried. The boiling points of the solvents thereby typically cannot be reached since the paper would thereby be damaged, such that they remain on the paper surface. Additional recording media—for example paperboard, cardboard or other material—also behave similarly.

Thermoplastics are often also added to the inks for more wear-stable systems. These may form stable films at the achievable temperatures. However, the film formation will be hindered or the generated film will remain softer due to the solvent on the surface of the recording medium (paper, for example). The solvents interfere with the processing process insofar as they cannot be removed from the surface of the recording medium (for example paper, paperboard or cardboard).

Similar problems occur given printing processes with liquid toners, in which mixtures of organic solvents are typically used that, however, are normally anhydrous.

In order to circumvent the above problems, the quantity of solvents is conventionally kept low, which however entails disadvantages in the processing in the print head (of an inkjet printer, for example).

Alternatively or additionally, the temperature at fixing is also set as high as possible for as long as possible in order to vaporize as much liquid as possible or in order to allow as much liquid as possible to penetrate into the recording medium (paper, for example), which may, however, damage the recording medium and is also disadvantageous from economic and ecological standpoints.

Moreover, a longer path for the recording medium may be inserted between the print groups and the fixing station, in order to enable the penetration of the solvent into the paper. However, this extends the printing process and requires larger printing devices, which is likewise uneconomical.

Finally, recording media such as paper may also be modified and made more absorbent to liquids. However, the recording media are thereby more expensive and require a more complicated a more complicated manufacturing.

Therefore, a need exists for a method and a device with which printed recording media may be effectively treated and fixed so that optimally no solvent remains on the recording medium.

BRIEF DESCRIPTION OF THE DRAWINGS

The present disclosure is explained in detail in the following using the exemplary embodiments indicated in schematic Figures of the drawings. Thereby shown are.

Figure 1:
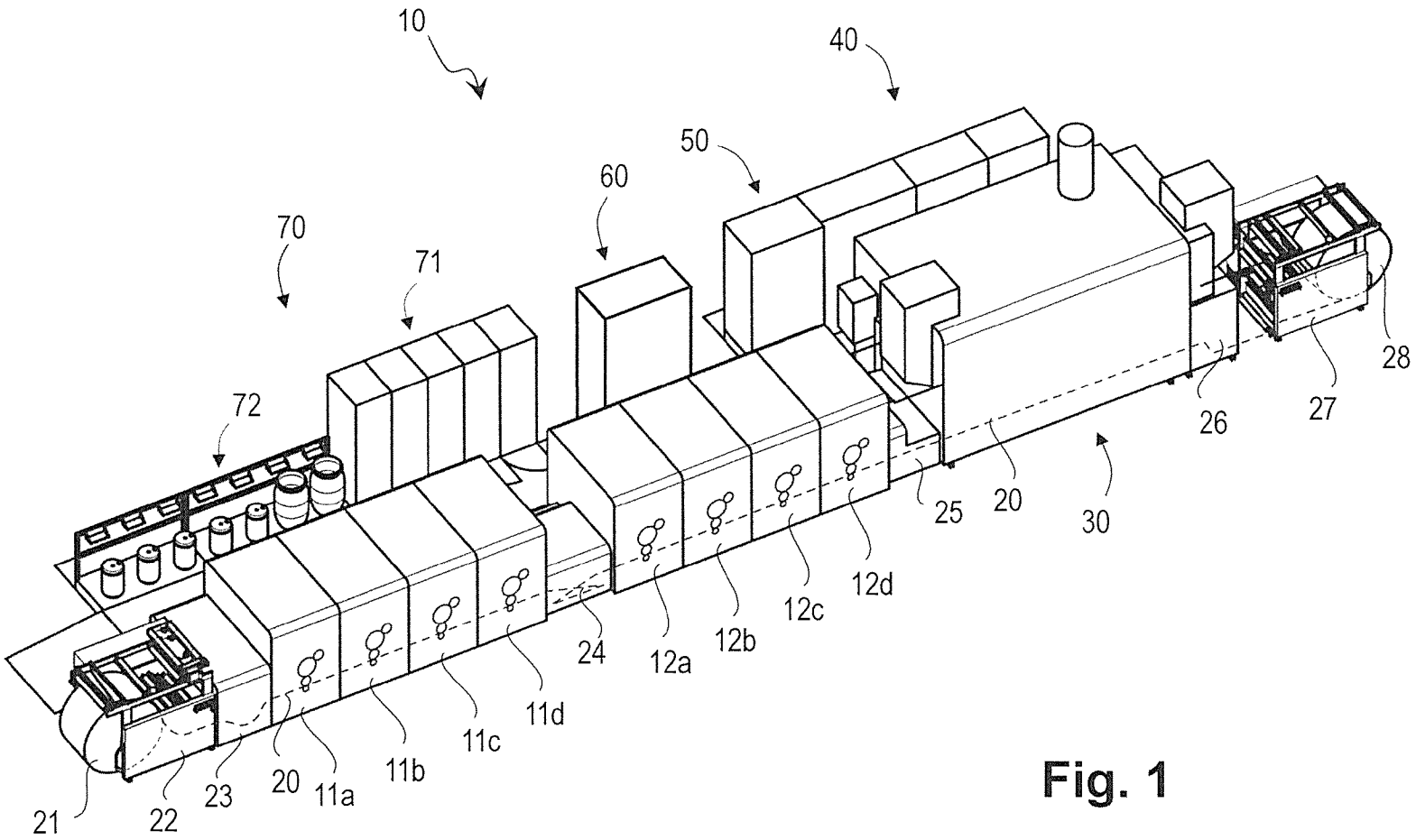
FIG. 1 a schematic view of a digital printer in an exemplary configuration of a printing device according to the disclosure.

The elements of the drawings are not necessarily shown to scale with regard to one another.

In Figures of the drawings, elements, features and components that are identical, functionally identical or have the same effect, are—insofar as is not stated otherwise—respectively provided with the same reference character.

DETAILED DESCRIPTION

For the purposes of promoting an understanding of the principles of the disclosure, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the disclosure relates are included herein.

In light of the background, it is an object of the present disclosure to provide an improved method for effective treatment of a recording medium after printing, via which solvents on the surface of the recording medium may be better removed.

This object is achieved via a method with the features of Patent Claim 1 and/or via a printing device with the features of Patent Claim 10.

It has been discovered that the absorption [take-up] of solvents into the recording medium may be improved if the printed recording medium is pre-treated with heat before fixing. Via the interaction of the fluids in the liquid component of the ink or, respectively, liquid toner, the viscosity of said ink or liquid toner may hereby be further reduced, such that solvents may more easily transition into the recording medium. In particular, this may be achieved if the temperature is increased such that a solvent that is separated upon fixing is not yet vaporized upon heating. For example, a liquid with lower boiling point and lower viscosity (water, for example) may thus decrease the viscosity of the liquid component upon heating, such that organic solvents may transition more easily into the recording medium. The liquid with lower boiling point and lower viscosity may thus be used as a transport medium, for example, in order—for example—to transport an organic liquid with high viscosity and higher boiling point into the recording medium. The energy required for this is minimized via the heat treatment, whereby the transport of the fluid with higher viscosity and higher boiling point into the recording medium is facilitated or enabled for the first time, such that an optimally more complete transport into the recording medium may take place. A specially treated recording medium (such as a specially treated paper) is hereby unnecessary, and the dependency of the penetration on the properties of the recording medium is reduced.

Via the present method and the present printing device, it may be achieved that the solvents of an ink or of a liquid toner penetrate as completely as possible into a recording medium (such as paper) and/or may be removed as completely as possible, for example via vaporization. The time that is necessary for this, and therefore the machine size of the printing device, may be minimized. In addition to this, the fixing effect may be improved and the abrasion resistance of the finished print good may be optimized. Contamination due to abrasion in the machine may thus be minimized or even avoided entirely.

Advantageous embodiments and developments result from the additional dependent Claims and from the description with reference to Figures of the drawings.

The embodiments and developments in the Claims may—insofar as is reasonable—be arbitrarily combined with one another. Additional possible embodiments, developments and implementations of the disclosure also include combinations of previous features of the disclosure, or features that are described in the following with regard to the exemplary embodiments that are not explicitly cited. In particular, the person skilled in the art will thereby also add individual aspects as improvements or extensions to the respective basic form of the present disclosure.

First, within the context of the present Patent Application the following terms should be understood as follows:

According to the disclosure, recording media containing pulp and free of pulp are considered as recording media, wherein these recording media containing pulp preferably have at least a porous structure.

Within the scope of the disclosure, pulp is the fibrous mass, most often comprised predominantly of cellulose that accumulates upon pulping of wood or other plant fibers. Recording media that are based purely on cellulose are also to be understood as pulp-containing recording media according to the disclosure.

For example, to be cited as pulp-containing recording media are thus those based on pulp-containing paper, for example also recycled paper, paperboard and/or cardboard or, respectively, cardboard packaging.

Moreover, pulp-free papers or other pulp-free materials are known that may be used as recording media according to the disclosure, wherein such pulp-free recording media preferably have a porous structure, for example specific woven substances to be printed to.

According to preferred embodiments, however, pulp-containing recording media are used.

According to specific embodiments, the recording media include paper, paperboard and/or cardboard, for example paper and/or cardboard.

According to a first aspect, the present disclosure concerns a method to print to a recording medium with at least one ink or at least one liquid toner/liquid developer whose liquid component has multiple fluids, wherein the recording medium is treated with heat in a range from 40 to 80° C. after the printing and before the fixing, and after this is fixed at a temperature of at least 90° C. According to specific embodiments, the treatment with heat may preferably take place in a range from 50 to 75° C., for example at approximately 70° C. According to specific embodiments, the fixing may take place at a temperature above 100° C. (for example above 110 or 120° C.), in particular if water is included as a solvent in the liquid component.

According to the disclosure, the printing is not particularly limited and may take place on one side or both sides.

The ink or the liquid toner is not further limited with regard to their composition insofar as they have at least two fluids, for example water and at least one organic solvent, or also at least two organic solvents. Moreover, the included dyes or pigments and/or resins may be present in a solid or liquid form and are not limited further. In addition to this, the ink or the liquid toner may include additional components, for example thermoplastics or other additives, for example surfactant substances, corrosion protection agents, charge control substances, or fungicides or herbicides.

The solvents in the liquid component are not especially limited and, for example, may include those which may be conventionally included in ink or liquid toner. For example, such solvents are known from U.S. Pat. No. 6,498,202, which is herewith incorporated by reference with regard to the solvents. According to specific embodiments, the liquid component comprises at least one first and one second fluid.

According to specific embodiments, a first of the fluids (thus a first fluid, for example water or an organic solvent) has a lower viscosity (for example less than 1.00 mPa·s) than another second fluid and/or additional fluids in a range from 40 to 80° C., and in addition to this also has—according to specific embodiments—a lower boiling point (for example less than 110° C.) than this other second fluid and/or the additional fluids. Upon heating to 40 to 80° C., the viscosity of the liquid component can hereby be further reduced via the interaction of the at least first and second fluids (as well as possible additional fluids) in the liquid component of the ink or the liquid toner, such that the second fluid (an organic solvent, for example) and/or the additional fluids may transition more easily into the recording medium. In particular, this may be achieved if the temperature is increased such that a solvent that separated upon fixing—such as the first fluid, for example water—is not yet vaporized upon heating, thus for example is heated to below the boiling point of the first fluid (for example 100° C. for water under normal conditions).

According to specific embodiments, the first fluid thus has a boiling point of more than 80° C., preferably more than 90° C., furthermore preferably of 100° C. or more under normal pressure. According to specific embodiments, the second fluid thus furthermore also has a boiling point of more than 80° C., preferably more than 90° C., furthermore preferably of 100° C. or more, even further preferably of 110° C. or more under normal pressure. For example, the first fluid with lower boiling point and lower viscosity (for example water) may lower the viscosity of the liquid component upon heating, such that the second fluid (for example an organic solvent and/or additional fluids) may transition more easily into the recording medium. For example, the first fluid with lower viscosity (and if applicable lower boiling point) may thus be used as a transport medium, for example in order to transport the second fluid with higher viscosity (for example more than 1.0 mPa·s or more than 100 mPa·s) and—if applicable—higher boiling point (for example 110° C. or more) into the recording medium. The resistance to the penetration of the fluid is minimized via the heat treatment, whereby the transport of the second fluid with higher viscosity and—if applicable—higher boiling point into the recording medium is facilitated or, respectively, is enabled for the first time, such that an optimally complete transport into the recording medium may take place. A specially treated recording medium (such as specially treated paper) is hereby unnecessary, and the distance for the transport of fluids such as the second fluid into the recording medium may be minimized.

According to specific embodiments, the first fluid comprises or is water and/or an organic solvent such as Isopar™ N and/or Isopar™ M. Mixtures of first fluids are also possible. Mixtures of second fluids are likewise possible. According to specific embodiments, the second fluid does not comprise methanol. According to specific embodiments, the second fluid comprises or is at least one organic solvent that is selected from the group comprised of alcohols, for example glycols such as 2,2'-thiodiethanol, glycerol, 1,2-propylene glycol, 1,3-propylene glycol, 1,5-pentanediol, polyethylene glycol, ethylene glycol, diethylene glycol, propylene glycol, tetraethylene glycol and hexylene glycol; monoalcohols such as n-propanol and isopropanol; pyrrolidones such as 2-pyrrolidone, N-methyl-2-pyrrolidone; N-methyl-2-oxazolidinone; oils such as mineral oil or silicone oil, for example with a viscosity in the range from 5 to 100 mPa·s, for example 10 to 50 mPa·s; and mixtures of these.

According to specific embodiments, the liquid component comprises at least one organic solvent that is selected from the group comprised of alcohols, for example glycols such as 2,2'-thiodiethanol, glycerol, 1,3-propylene glycol, 1,5-pentanediol, polyethylene glycol, ethylene glycol, diethylene glycol, propylene glycol, tetraethylene glycol and hexylene glycol; monoalcohols such as n-propanol and isopropanol; pyrrolidones such as 2-pyrrolidone, N-methyl-2-pyrrolidone; N-methyl-2-oxazolidinone; oils such as mineral oil or silicone oil, for example with a viscosity in the range from 5 to 100 mPa·s, for example 10 to 50 mPa·s; and mixtures of these.

What is to be understood as mineral oil are oils produced via distillation of petroleum, and possibly also other raw mineral materials, which may generally include paraffinic (saturated hydrocarbon chains), naphthenic (saturated hydrocarbon rings) and aromatic (hydrocarbon rings with aromatic double bond system) components, as well as possibly olefins and/or possible organic sulfur and/or nitrogen compounds.

Apart from the two included fluids, the ink or, respectively, the liquid toner is not limited further. A water-based pigment ink is to be cited as an example of an ink. An example liquid toner/liquid developer, for example, comprises mineral oil as a liquid carrier, toner particles with resins and color pigments which may be liquescent or non-liquescent, and additives such as charge control substances.

The treatment of the printed recording medium with heat before fixing is not especially limited with regard to the duration of the treatment, wherein the duration is preferably set such that organic solvents may penetrate as completely as possible into the recording medium or, respectively, be absorbed as completely as possible by the recording medium. According to specific embodiments, the treatment with heat takes place for a duration of 0.01 to 20 s, preferably 0.1 to 10 s, additionally is preferably implemented for 1 to 5 s. Given too short a duration, an insufficient transfer of organic solvent into the recording medium takes place, while too long a duration does not achieve any further improvement and therefore is not economical. Due to the guidance of a recording medium in a printing device (in particular an automatic printing device), the duration of the heat treatment also corresponds to a specific path that the recording medium must travel through a mechanism for heat treatment, such that a longer treatment with heat also leads to a correspondingly enlarged mechanism for heat treatment and thus a larger printing device, which is not economical and also may consume unnecessary power.

According to specific embodiments, the recording medium is not heated independently upon being printed to, in particular is not heated by (for example) a heating mechanism in a transport device of the recording medium. However, this does not preclude that the ink or the liquid toner is heated in the print head, for example to a temperature between 25 and 38° C., for example between 30 and 35° C. According to specific embodiments, the recording medium is not heated to a temperature of 40° C. or more—preferably of not more than 35° C.—upon being printed to, not even by the application of the ink or liquid toner. In particular, if—according to specific embodiments—no heating of the recording medium occurs due to heating devices (such as thermal or electrical heating devices) upon printing, no transport mechanism of the recording medium is thus provided with a heating device in the region of the printing.

According to specific embodiments, the ink or the liquid toner additionally has at least one thermoplastic such as latex. Upon fixing, due to the previously improved transition of the liquid component or of fluids into the recording medium, the thermoplastic may form a closed film on the recording medium, wherein the film formation is not disrupted or is only slightly disrupted by remaining fluid or liquid component. After the fixing, a printed, coated recording medium with improved properties (for example improved abrasion resistance) is created. The thermoplastic or the latex is not especially limited and, for example, may be based on styrene, methyl methacrylate, alkyl acrylate etc., wherein suitable thermoplastics or latexes are known from (for example) U.S. Pat. No. 6,498,202, which is herewith incorporated by reference with regard to the thermoplastics or latexes.

The heat treatment is not limited with regard to its progression and, for example, may take place with continuous increase of temperature, stepped increase of temperature or at essentially constant temperature. However, according to specific embodiments the power for heating may be minimized via a heat treatment at an essentially constant temperature, since the setting of a suitable viscosity for an efficient, fast transition of fluids in bulk or given correspondingly large quantities of liquid component or, respectively, given corresponding mixture ratios of the fluids in the liquid component is temperature-dependent, such that a temperature increase yields no significant increase in the transition of fluid into the recording medium.

The heat treatment may take place via suitable mechanisms in a printing device and is not especially limited, wherein specific heating systems (such as infrared radiators, heating saddles, heated drums, hot air jets or microwave systems) may be used for this, for example. According to specific embodiments, the heat treatment may take place with at least one mechanism for heat treatment that is selected from the group comprised of infrared radiators, heating saddles and heated drums, which may be realized simply in terms of systems engineering and allow a good temperature control.

According to specific embodiments, the ink or the liquid toner may additionally have at least one surfactant substance, whereby an additional improvement of the transition of fluids into the recording medium may be achieved by lowering the surface tension. The surfactant substance is hereby not especially limited and, for example, may comprise sodium lauryl sulfate or acetylene glycols.

According to specific embodiments, ink is used, and the ink includes additional water as a fluid, wherein the water may (for example) then be used as a fluid with lower viscosity and lower boiling temperature that, upon heating, improves the transfer of (for example organic) solvents as a fluid into the recording medium, and then may simply be separated again upon fixing via vaporization, for example.

In specific embodiments, the method for printing to the recording medium with an ink or a liquid toner that contains water and solvent is implemented with at least two organic solvents as fluids, wherein the recording medium is treated with heat in a range from 40 to 80° C. after printing and before fixing, and after this is fixed at a temperature of at least 90° C.

According to a further aspect, the present disclosure additionally concerns a printing device for printing to a recording medium with at least one ink or at least one liquid toner whose liquid component has multiple fluids, with: at least one printing mechanism for the ink or liquid toner, which printing device is designed to print to the recording medium on at least one side of said recording medium with the ink or liquid toner; at least one mechanism for heat treatment in a range from 40 to 80° C. that is designed to treat the printed recording medium with heat in a range from 40 to 80° C.; and at least one fixing station that is designed to fix the recording medium in the printing direction at a temperature of at least 90° C., after the heat treatment.

The type of printing device is not especially limited, and typical printing devices (for example digital printers, offset printers etc.) may be used in which a corresponding heat treatment takes place according to the disclosure before the fixing. In a printing device according to the disclosure, more than one printing mechanism may also be provided, for example for two-sided printing. In addition to this, printing with one or more colors may occur. Furthermore, a printing device according to the disclosure may if applicable comprise one or more intermediate fixing mechanisms, turning mechanisms and cooling and/or heating devices to adjust a desired print temperature. A device for re-moistening the recording medium may also be provided, or additional mechanisms for pre- and post-treatment of the unprinted or, respectively, printed recording medium in addition to the mechanism for heat treatment. In addition to this, corresponding rollers for printing, treating and/or directing the recording medium; mechanisms for transferring a print template to the recording medium; reservoirs for printing inks etc. may be present in printing devices according to the disclosure. Moreover, mechanisms that are typically present in existing printing devices may be included in a printing device according to the disclosure, and these as well as the aforementioned mechanisms may be suitably arranged depending on the printing process, desired product or recording medium that is used.

The type of fixing station is not especially limited and may include fixing stations that are typically used in printing devices, for example specific heating systems such as infrared radiators, heating saddles, heated drums, hot air jets or microwave systems, or other systems to apply hot air or microwaves, preferably infrared radiators, heating saddles and heated drums. The hot air jets, microwave systems, infrared radiators, heating saddles and heated drums etc. are not hereby especially limited.

The mechanism for heat treatment in a range from 40 to 80° C. is likewise not especially limited and may be suitably provided, for example in the form of diverse heating devices, for example specific heating systems such as infrared radiators, heating saddles, heated drums, hot air jets or microwave systems, or other systems to apply hot air or microwaves, preferably infrared radiators, heating saddles and heated drums. The hot air jets, microwave systems, infrared radiators, heating saddles and heated drums etc. are not hereby especially limited.

According to specific embodiments, the mechanism for heat treatment is selected from the group comprised of infrared radiators, heating saddles and heated drums, which group is simple to realize in a printing device and allows a good temperature control. The infrared radiators, heating saddles and heated drums are hereby not especially limited.

Multiple mechanisms for heat treatment may also be provided in order to achieve temperature gradients and/or stepped temperature increases upon heat treatment. According to specific embodiments, however, the at least one mechanism for heat treatment is designed such that the printed recording medium is essentially treated uniformly with heat. In the at least one mechanism for heat treatment, the heat treatment may take place for a duration of 0.01 to 20 s, preferably 0.1 to 10 s, furthermore preferably 1 to 5 s, which may be achieved via corresponding arrangement and/or size of the at least one mechanism for heat treatment and may be suitably provided, for example using simulation data.

According to specific embodiments, no mechanism for heat treatment (for example a thermal or electrical heating device) is provided outside of the printing device in the region of the printing to the recording medium, thus in the region in which the printing device applies the ink or the liquid toner to the recording medium. However, this does not preclude that the ink or the liquid toner is heated by a heating device in the printing device (for example in the print head), for example to a temperature between 25 and 38° C., for example between 30 and 35° C., wherein a cooling or a corresponding cooling device of the print head may also be provided for a suitable tempering upon printing. According to specific embodiments, no transport mechanism of the recording medium is provided with a heating device in the region of printing. According to specific embodiments, no mechanism for heat treatment—for example a thermal or electrical heating device—is provided in the region of printing to the recording medium, thus in the region in which the printing device applies the ink or the liquid toner to the recording medium.

An exemplary embodiment of a position overview data according to the disclosure in the form of a digital printer for two-sided printing to a recording medium (with liquid toner, for example) is shown in FIG. 1, wherein the disclosure is, however, not limited to this. Naturally, a printing device for one-sided printing may also be realized according to the disclosure, wherein then correspondingly unnecessary components of the printing device may be absent.

According to FIG. 1, a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium 20 as a recording medium 20 may be unspooled from a roll 21 with the aid of a take-off 22 and is supplied to the first print group 11*a*. The print image 20' is fixed on the recording medium 20 in a fixer 30 with a mechanism provided therein for heat treatment, and a fixing station (not shown in detail, additional details in the following) following in the printing direction. The recording medium 20 may subsequently be taken up on a roll 28 with the aid of a take-up 27. Such a configuration is also designated as a roll-to-roll printer.

In the preferred configuration shown in FIG. 1, the web-shaped recording medium 20 is printed to in full color on the front side with four print groups 11*a* through 11*d* and on the back side with four print groups 12*a* through 12*d* (what is known as a 4/4 configuration). For this, the recording medium 20 is unwound from the roll 21 by the take-off 22 and supplied to the first print group 11*a* via the conditioning group 23. In the conditioning group 23, the recording medium 20 may be pre-treated with a suitable substance as desired, for example.

The recording medium 20 is subsequently supplied first, in order, to the first print groups 11*a* through 11*d*, in which only the front side is printed to. Each print group 11*a*-11*d* typically prints to the recording medium 20 with a liquid developer or, respectively, a transfer fluid in a different color, or also with a different toner material (for example MICR toner which can be read electromagnetically) in the liquid developer.

After printing to the front side, the recording medium 20 may be turned in a turner 24 and be supplied to additional print groups 12*a*-12*d* for printing to the back side. In the region of the turner 24, an additional conditioning group (not shown) may optionally be arranged via which the recording medium 20 is prepared for the printing to the back side, for example a fixing/intermediate fixing (partial fixing) or other conditioning of the previously printed front side print image (or of the entire front side, or also the back side). It is thus prevented that the front-side print image is mechanically damaged upon further transport through the subsequent print groups.

In order to achieve a full-color printing, at least four colors (and therefore at least four print groups 11, 12) are required, and in fact the primary colors YMCK (Yellow, Magenta, Cyan and Black), for example. Still more print groups 11, 12 with special colors (for example customer-specific colors or additional primary colors in order to expand the printable color space) may also be used.

Arranged after the print group 12*d* is a register 25 via which registration marks—which are printed on the recording medium 20 independently of the print image 20' (in particular outside of the print image 20')—are evaluated. The transversal and longitudinal registration (the primary color dots that form a color point should be arranged atop one another or spatially very close to one another; this is also designated as color registration or four-color registration) and the register (front side and back side must spatially coincide precisely) can therefore be adjusted so that a qualitatively good print image 20' is achieved.

Arranged after the register 25 is the fixer 30 via which the print image 20' is initially treated with a mechanism for heat treatment so that fluids of the carrier fluid/liquid component of the liquid toner (for example with high viscosity and high boiling point, if applicable) can transition into the recording medium 20 before the recording medium 20 is fixed, wherein additional fluids of the carrier fluid may be vaporized. Given electrophoretic digital printers, for example, a thermal dryer is used that largely vaporizes the remaining carrier fluid so that only the toner particles still remain on the recording medium 20. The toner particles may thereby also be fused onto the recording medium 20 insofar as they have a material (resin, for example) that can melt as a result of the effect of heat.

Arranged after the fixer 30 is a puller 26 that pulls the recording medium 20 through all print groups 11*a*-12*d* and the fixer 30 without an additional drive being arranged in this region. The danger that the as of yet unfixed print image 20' could be smeared would exist due to a friction drive for the recording medium 20.

The puller 26 feeds the recording medium 20 to the take-up 27, which rolls up the printed recording medium 20.

Centrally arranged in the print groups 11, 12 and the fixer 30 are all supply devices for the digital printer 10, such as air-conditioners 40, power supply 50, controller 60, fluid manager 70 (such as fluid controller 71 and reservoirs 72 of the different fluids). In particular, pure carrier fluid (comprising oil or organic solvent, for example), highly-concentrated liquid developer (high proportion of toner particles in relation to carrier fluid comprising oil or organic solvent) and serum (liquid developer plus charge control substances) are required as fluids in order to supply the digital printer 10, as well as waste containers for fluids to be disposed of or containers for cleaning fluid.

The digital printer 10, with its structurally identical print groups 11, 12, is of modular design. The print groups 11, 12 do not differ mechanically, but rather only due to the liquid developer (toner color or toner type) used therein.

Figure 2:
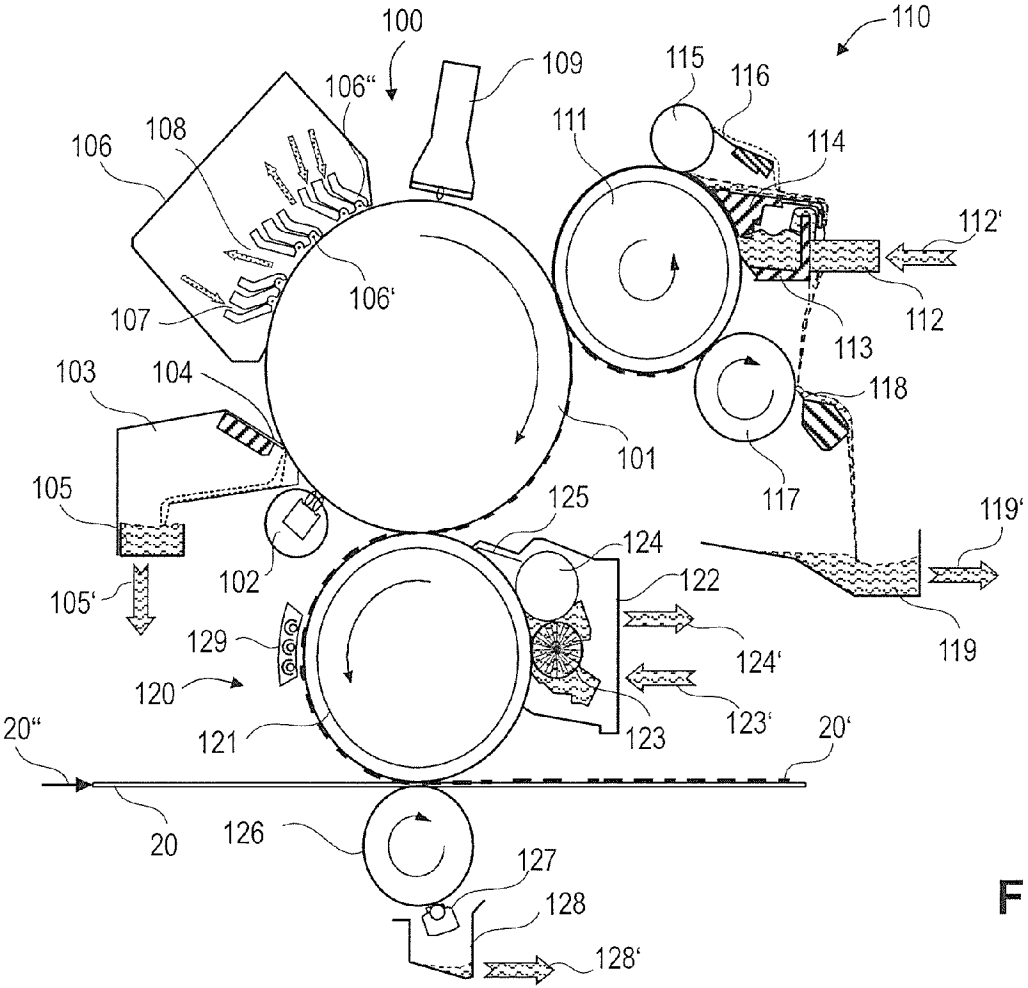
FIG. 2 a schematic design of a print group of the digital printer according to FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a manner is transferred to the recording medium 20.

The print group 11, 12 is essentially comprised of an electrophotography station 100, a data stream 110 and a transfer station 120.

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in the arrow direction).

The photoconductor is initially cleaned of all contaminants. For this, an erasure light 102 is present that erases charges that still remain on the surface of the photoconductor. The erasure light 102 can be calibrated (is locally adjustable) in order to achieve a homogeneous light distribution. The surface may therefore be pre-treated uniformly.

After the erasure light 102, a cleaner 103 mechanically cleans off the photoconductor in order to remove toner particles that are possibly still present on the surface of the photoconductor, possible dirt particles and remaining carrier fluid. The cleaned-off carrier fluid is supplied to a collection container 105. The collected carrier fluid and toner particles are prepared (filtered as necessary) and fed—depending on color—to a corresponding liquid color reservoir, i.e. to one of the storage containers 72 (see arrow 105').

The cleaner 103 preferably has a blade 104 that rests on the surface shell of the photoconductor roller 101 at an acute angle (approximately 10° to 80° relative to the outflow surface) in order to mechanically clean off the surface. The blade 104 may move back and forth, transversal to the rotation direction of the photoconductor roller 101, in order to optimally clean the surface shell along the entire axial length with as little wear as possible.

The photoconductor is subsequently charged by a charger 106 to a predetermined electrostatic potential. For this, multiple corotrons (in particular glass shell corotrons) are preferably present. The corotrons are comprised of at least one wire 106' at which a high electrical voltage is present. The air around the wire 106' is ionized by the voltage. A shield 106" is present as a counter-electrode. The corotrons are additionally flushed with fresh air that is supplied via special air channels (air feed channel 107 for aeration and exhaust channel 108 for ventilation) between the shields (see also the air flow arrows in FIG. 2). The supplied air is then uniformly ionized at the wire 106'. A homogeneous, uniform charging of the adjacent surface of the photoconductor is thereby achieved. The uniform charging is further improved with dry and heated air. Air is discharged via the exhaust channels 108. Ozone that is possibly created may likewise be drawn away via the exhaust channels 108.

The corotrons can be cascaded, meaning that then two or more wires 106' are present per shield 106" given the same shielding voltage. The current that flows across the shield 106" is adjustable, and the charge of the photoconductor is thereby controllable. The corotrons may be fed with currents of different strengths in order to achieve a uniform and sufficiently high charge at the photoconductor.

Arranged after the charging device 106 is a character generator 109 that, via optical radiation, discharges the photoconductor per pixel depending on the desired print image 20'. A latent image is thereby created that is later inked with toner particles (the inked image corresponds to the print image 20'). An LED character generator 109 is preferably used, in which an LED line with many individual LEDs is arranged stationary over the entire axial length of the photoconductor roller 101. The number of LEDs and the size of the optical mapping points on the photoconductor 101 determine (among other things) the resolution of the print image 20' (typical resolution is 600×600 dpi). The LEDs may be controlled with individual timing and with regard to their radiation power. To generate raster points (comprised of multiple image points or pixels), multi-level methods may thus be applied or image points may be chronologically delayed in order to electro-optically implement corrections, for example given an incorrect color registration or register.

The character generator 109 has a control logic that must be cooled due to the plurality of LEDs and their radiation power. The character generator 109 is preferably liquid-cooled. The LEDs may be activated in groups (multiple LEDs combined into a group) or separately from one another.

The latent image generated by the character generator 109 is inked with toner particles by the developer station 110. The developer station 110 has for this a rotating developer roller 111 that directs a layer of liquid developer towards the photoconductor (the functionality of the developer station 110 will be explained in detail further below). Since the surface of the photoconductor roller 101 is relatively hard, the surface of the developer roller 111 is relatively soft, and if the two are pressed against one another a thin, high nip (a gap between the rollers) is created in which the charged toner particles migrate electrophoretically from the developer roller 111 onto the photoconductor at the image points, due to an electrical field. No toner transfers to the photoconductor at the non-image points. The nip filled with liquid developer has a height (width of the gap) that is dependent on the mutual pressure of the two rollers 101, 111 and the viscosity of the liquid developer. The width of the nip is typically in a range of greater than approximately 2 μm up to approximately 20 μm (the values may also change depending on viscosity of the liquid developer). The length of the nip is approximately a few millimeters.

The inked image rotates with the photoconductor roller 111 up to a first transfer point at which the inked image is essentially completely transferred to a transfer roller 121. At the first transfer point (nip between photoconductor roller 101 and transfer roller 121), the transfer roller 121 moves in the same direction as the photoconductor 101 and preferably at an identical speed. After the transfer of the print image 20' to the transfer roller 121, the print image 20' (toner particles) may optionally be recharged or charged by means of a charge unit 129 (a corotron, for example) in order to be able to subsequently better transfer the toner particles to the recording medium 20.

The recording medium 20 travels through between the transfer roller 121 and a counter-pressure roller 126, in the transport direction 20". The contact region (nip) represents a second transfer point at which the toner image is transferred to the recording medium 20. In the second transfer region, the transfer roller 121 moves in the same direction as the recording medium 20. The counter-pressure roller 126 also rotates in this direction in the region of the nip. The velocities of the transfer roller 121, the counter-pressure roller 126 and the recording medium 20 are matched to one another at the transfer point and are preferably identical so that the print image 20' is not smeared. At the second transfer point, the print image 20' may be electrophoretically transferred onto the recording medium 20 due to an electrical field between the transfer roller 121 and the counter-pressure roller 126. Moreover, the counter-pressure roller 126 typically presses against the relatively soft transfer roller 121 with a large mechanical force, whereby the toner particles may also remain stuck to the recording medium 20 due to the adhesion.

Since the surface of the transfer roller 121 is relatively soft and the surface of the counter-pressure roller 126 is relatively hard, upon rolling a nip is created in which the toner transfer occurs. Unevenness of the recording medium 20 may therefore be compensated so that the recording medium 20 may be printed to without gaps. Such a nip is also well suited in order to print to thicker or more uneven recording media 20, for example as is the case given printing of packaging.

The print image 20' should in fact transfer completely to the recording medium 20; nevertheless, a few toner particles may undesirably remain on the transfer roller 121. A portion of the carrier fluid always remains on the transfer roller 121 as a result of the wetting. The toner particles that are possibly still present should be nearly completely removed by a cleaner 122 following the second transfer point. The carrier fluid still located on the transfer roller 121 may also be completely removed from the transfer roller 121, or be removed up to a predetermined layer thickness so that, after the cleaner 122 and before the first transfer point from the photoconductor roller 101 to the transfer roller 121, the same conditions prevail due to a clean surface or a defined layer thickness with liquid developer on the surface of the transfer roller 121.

This cleaner 122 is preferably designed as a wet chamber with a cleaning brush 123 and a cleaning roller 124. In the region of the brush 123, cleaning fluid (for example, carrier fluid or a separate cleaning fluid may be used) is supplied via a cleaning fluid feed 123'. The cleaning brush 123 rotates in the cleaning fluid and thereby "brushes" the surface of the transfer roller 121. The toner adhering to the surface is thereby loosened.

The cleaning roller 124 is at an electrical potential that is opposite the charge of the toner particles. As a result of this, the electrically charged toner is removed from the transfer roller 121 by the cleaning roller 124. Since the cleaning roller 124 contacts the transfer roller 121, it also removes carrier fluid (together with the supplied cleaning fluid) remaining on said transfer roller 121. A conditioner 125 is arranged at the outflow from the wet chamber. As shown, a retention plate that is arranged at an obtuse angle (for instance between 100° and 175° between plate and outflow surface) relative to the transfer roller 121 may be used as a conditioner 125, whereby residues of fluid on the surface of the roller are nearly completely kept back in the wet chamber and supplied to the cleaning roller 124 for removal via a cleaning fluid discharge 124' to a cleaning fluid reservoir (at the reservoirs 72) (not shown).

Instead of the retention plate, a dosing unit (not shown) may also be arranged there that, for example, has one or more dosing rollers. The dosing rollers have a predetermined clearance from the transfer roller 121 and remove so much carrier fluid that a predetermined layer thickness appears after the dosing roller as a result of the squeezing. The surface of the transfer roller 121 is then not completely cleaned off; and carrier fluid of a predetermined layer thickness remains over the entire surface. Removed carrier fluid is directed back via the cleaning roller 124 to the cleaning fluid reservoir.

The cleaning roller 124 itself is kept mechanically clean by a blade (not shown). Fluid that is cleaned off, inclusive of toner particles, is captured for all colors by a central capture container, cleaned, and supplied to the central cleaning fluid reservoir for reuse.

The counter-pressure roller 126 is likewise cleaned. A blade, a brush and/or a roller as a cleaning unit 127 may remove contaminants (paper dust, toner particle residues, liquid developer etc.) from the counter-pressure roller 126. The cleaned fluid is collected in a collection container 128 and provided again to the printing process (possibly after cleaning) via a fluid discharge 128'.

In the print groups 11 that print to the front side of the recording medium 20, the counter-pressure roller 126 presses against the unprinted side (thus the side that is still dry) of the recording medium 20.

Nevertheless, dust/paper particles or other contaminating particles may already be located on the dry side, which particles are then removed by the counter-pressure roller 126. For this, the counter-pressure roller 126 may be wider than the recording medium 20. As a result of this, contaminants outside of the print area may also be cleaned off well.

In the print groups 12 that print to the back side of the recording medium 20, the counter-pressure roller 126 presses directly on the as of yet unfixed, damp print image 20' of the front side. So that the print image 20' is not removed by the counter-pressure roller 126, the surface of the counter-pressure roller 126 may have anti-adhesion properties with regard to toner particles and also with regard to the carrier fluid on the recording medium 20.

The developer station 110 inks the latent print image 20' with a predetermined toner. For this, the developer roller 111 supplies toner particles to the photoconductor. In order to ink the developer roller 111 itself with a layer over its entire surface, liquid developer is initially supplied at a predetermined concentration from a mixing container (not shown; within the fluid control unit 71) via a fluid feed 112' to a reservoir chamber 112. From this reservoir chamber 112, the liquid developer is supplied in abundance to a pre-chamber 113 (a type of pan that is open at the top). An electrode segment 114 is arranged towards the developer roller 111, which electrode segment 114 forms a gap between itself and said developer roller 111.

The developer roller 111 rotates through the pre-chamber 113 that is open at the top and thereby carries liquid developer along in the gap. Excess liquid developer flows out from the pre-chamber 113 back to the reservoir chamber 112.

Due to the electrical field (formed by the electrical potentials) between the electrode segment 114 and the developer roller 111, the liquid developer in the gap is divided up into two regions, and in fact into: a layer region in proximity to the developer roller 111, in which layer region the toner particles concentrate (concentrated liquid developer); and a second region in proximity to the electrode segment 114, which is low in toner particles (very low-concentration liquid developer).

The layer of the liquid developer is subsequent transported further to a dosing roller 115. The dosing roller 115 squeezes out the upper layer of the liquid developer so that afterward a defined layer thickness of liquid developer—of approximately 5 μm thickness—remains on the developer roller 111. Since the toner particles are essentially located near the surface of the developer roller 111, in the carrier fluid, the outwardly situated carrier fluid is essentially squeezed out or retained and ultimately is returned back to a collection container 119, but not to the reservoir chamber 112.

As a result of this, it is predominantly highly concentrated liquid developer that is conveyed through the nip between dosing roller 115 and developer roller 111. A uniformly thick layer of liquid developer is thus created, with approximately 40 percent by mass toner particles and approximately 60 percent by mass carrier fluid after the dosing roller 115 (the mass ratios may also fluctuate more or less depending on the printing process requirements). This uniform layer of liquid developer is transported in the nip between the developer roller 111 and the photoconductor roller 101. There the image points of the latent image are then electrophoretically inked with toner particles, while no toner transfers to the photoconductor in the area of non-image points. Sufficient carrier fluid is absolutely necessary for electrophoresis. The fluid film divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 may again be coated with liquid developer under the same conditions and uniformly, remaining toner particles (these essentially represent the negative, untransferred print image) and liquid developer are electrostatically and mechanically removed by a cleaning roller 117. The cleaning roller 117 itself is cleaned by a blade 118. The cleaned-off liquid developer is supplied to the collection container 119 for reuse, to which collection container 119 the liquid developer cleaned off from the dosing roller 115 (by means of a blade 116, for example) and the liquid developer cleaned off from the photoconductor roller 101 (by means of the blade 104) are also supplied.

The liquid developer collected in the collection container 119 is supplied to the mixing container via the fluid discharge 119'. Fresh liquid developer and pure carrier fluid are also supplied to the mixing container as needed. Sufficient fluid at the desired concentration (predetermined ratio of toner particles to carrier fluid) must always be present in the mixing container. The concentration in the mixing container is continuously measured and regulated accordingly depending on the supply of the quantity of the cleaned-off liquid developer and its concentration as well as the quantity and concentration of fresh liquid developer or carrier fluid.

For this, extremely concentrated liquid developer, pure carrier fluid, serum (carrier fluid and charge control substances in order to control the charge of the toner particles) as well as cleaned-off liquid developer may be supplied separately from the corresponding reservoirs 72 to this mixing container.

The photoconductor 101 may preferably be designed in the form of a roller or as a continuous belt. An amorphous silicon may thereby be used as a photoconductor material, or an organic photoconductor material (also designated as OPC) may be used.

Instead of a photoconductor 101, other image carriers (such as magnetic, ionizable etc. image carriers) may also be used that do not operate according to the photoelectric principle but rather on which latent images according to other principles are impressed electrically, magnetically or otherwise, which latent images are then inked and ultimately are transferred to the recording medium 20.

LED rows or also lasers with corresponding scan mechanism may be used as a character generator 109.

The transfer element 121 may similarly be designed as a roller or as a continuous belt. The transfer element 121 may also be omitted. The print image 20' is then transferred directly from the photoconductor roller 101 to the recording medium 20.

What is to be understood by the term "electrophoresis" is the migration of the charged toner particles in the carrier fluid as a result of the action of an electrical field. In each transfer of toner particles, the corresponding toner particles essentially transfer completely to another element. After the two elements come into contact, the fluid film is split approximately in half as a result of the wetting of the participating elements, such that approximately one half remains adhered to the first element and the remaining portion remains adhered to the other element. The print image 20' is transferred and, in the next part, is then transported further in order to in turn allow an electrophoretic migration of the toner particles in the next transfer region.

The digital printer 10 may have one or more print groups 11 for printing to the front side and, if applicable, one or more print groups 12 for printing to the back side. The print groups 11, 12 may be arranged in a line, an L-shape or a U-shape.

Instead of the take-up unit 27, post-processing devices (not shown)—such as cutters, folders, stackers etc.—may also be arranged after the pulling unit 26 in order to bring the recording medium 20 into the final form. For example, the recording medium 20 could be processed to such an extent that a finished book is created in the end. The post-processing devices may likewise be arranged in a row or at an angle.

As was previously described as a preferred exemplary embodiment, the digital printer 10 may be operated as a roll-to-roll printer. It is also possible to cut the recording medium 20 into sheets at the end and to subsequently stack the sheets or suitably process them further (roll-to-sheet printer). It is likewise possible to feed a sheet-shaped recording medium 20 to the digital printer 10 and to stack the sheets or process them further at the end (sheet-to-sheet printer).

If only the front side of the recording medium 20 is printed to, at least one print group 11 with one color is required (simplex printing). The at least one print group 11 may also be designated as a simplex print group. If the back side is also printed to, at least one print group 12 is also required for the back side (duplex printing). Depending on the desired print image 20' on the front side and back side, the printer configuration includes a corresponding number of print groups for front side and back side, wherein each print group 11, 12 is always designed for only one color or one type of toner.

The maximum number of print groups 11, 12 is only technically dependent on the maximum mechanical tensile load of the recording medium 20 and the free draw length. Typically, arbitrary configurations from a 1/0 configuration (only one print group for the front side to be printed to) up to a 6/6 configuration (in which six print groups may respectively be present for front side and back side of the recording medium 20) are possible. The preferred embodiment (configuration) is shown in FIG. 1 (a 4/4 configuration), with which the full-color printing for front side and back side with the four primary colors is accomplished. The order of the print groups 11, 12 in a four-color printing preferably goes from a print group 11, 12 that prints light (yellow) to a print group 11, 12 that prints dark; for example, the recording medium 20 is printed to from light to dark in the color order Y-C-M-K.

The recording medium 20 may be manufactured from paper, paperboard, cardboard, metal, plastic and/or other suitable and printable materials, as well as pulp-free but preferably pulp-containing materials.

Figure 3:
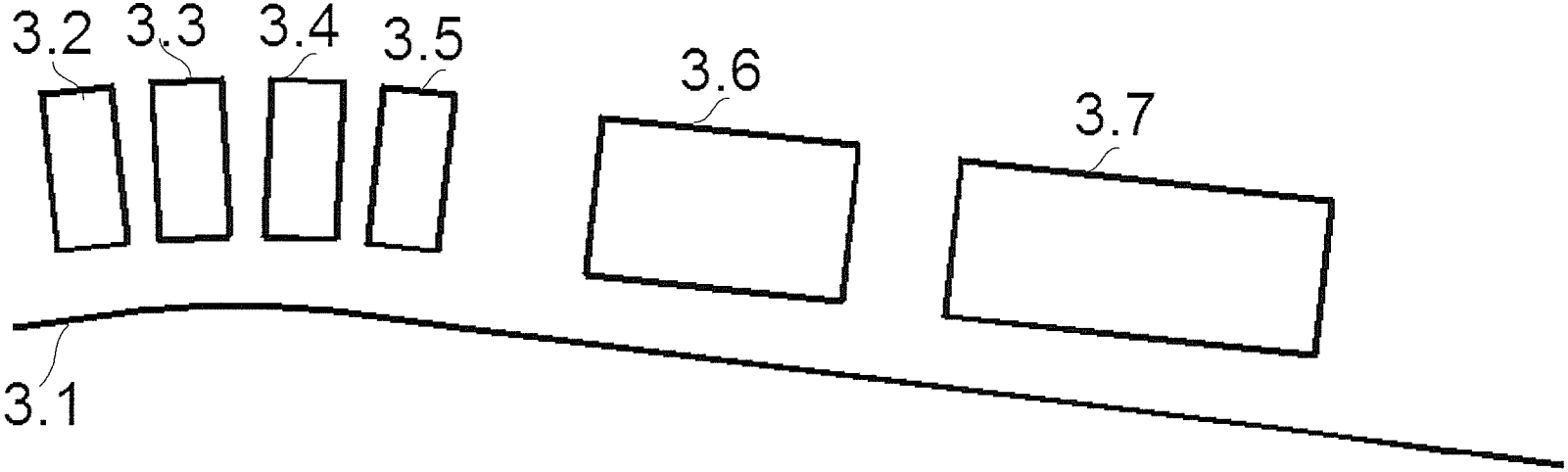
FIG. 3 a schematic view of an exemplary embodiment according to the present disclosure.
Figure 4:
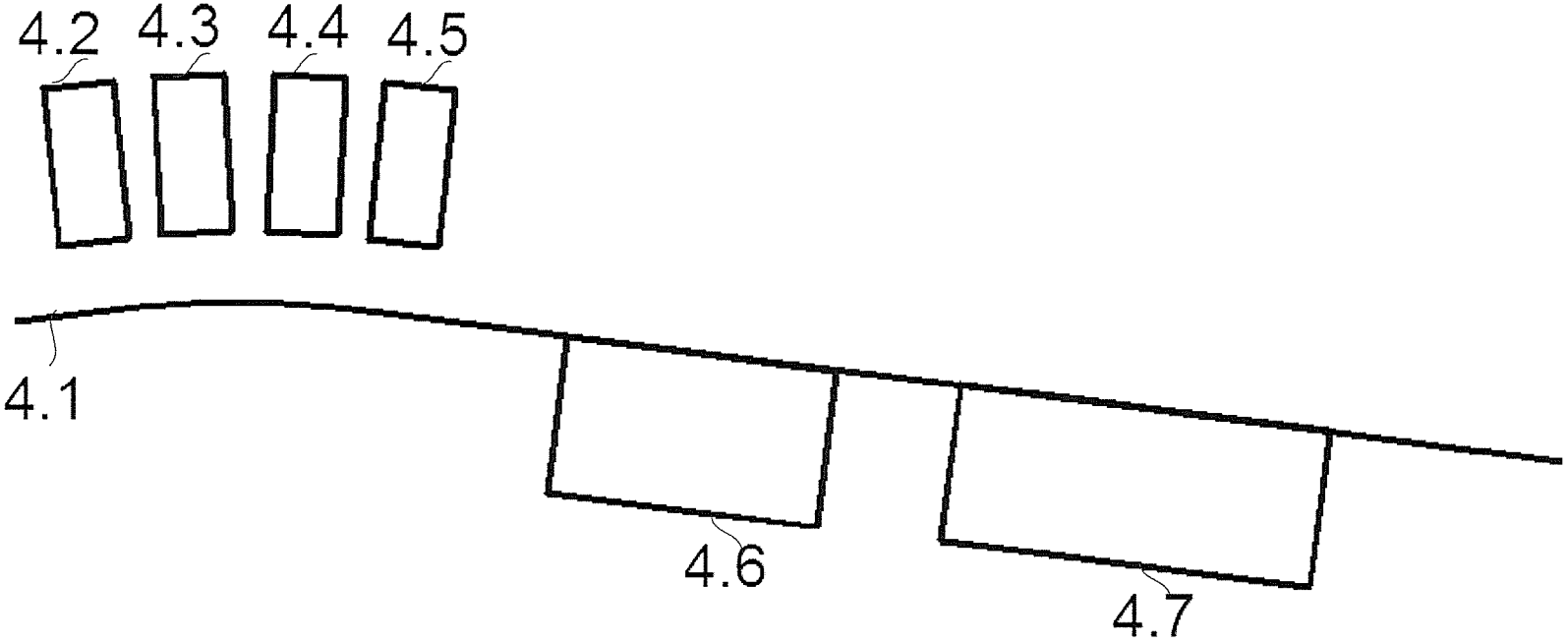
FIG. 4 an additional schematic view of an exemplary embodiment according to the present disclosure.
Figure 5:
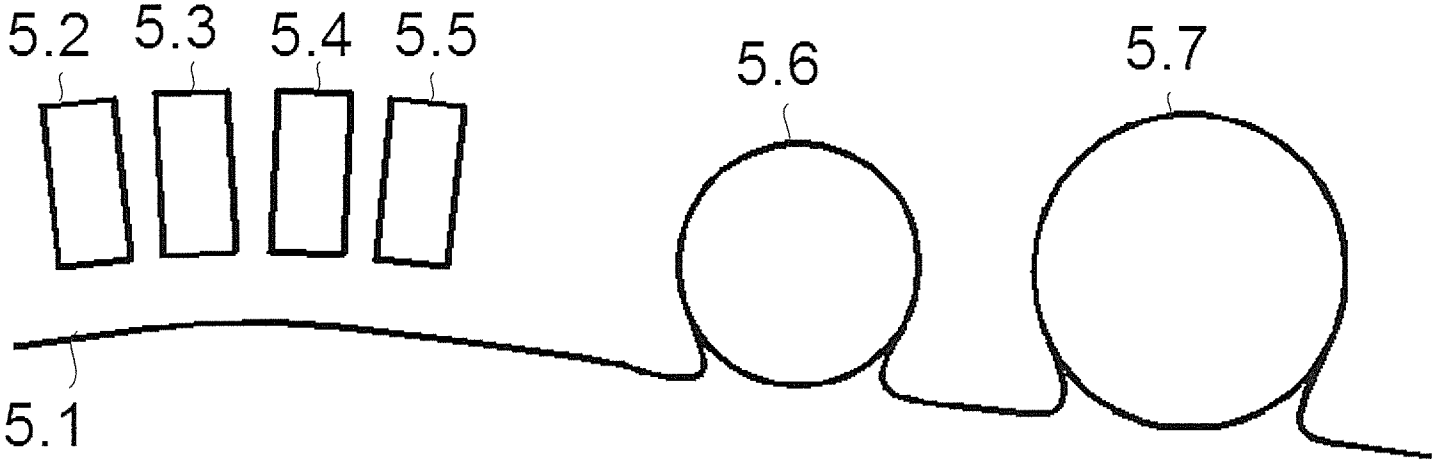
FIG. 5 yet another additional schematic view of an exemplary embodiment according to the present disclosure.

Exemplary embodiments of a printing device with simplex printing are presented in FIGS. 3 through 5, which exemplary embodiments are naturally also applicable to the exemplary embodiment indicated above in FIGS. 1 and 2 and may be designed accordingly in terms of structure.

Presented in FIGS. 3 through 5, again schematically, are printing devices with four print heads or, respectively, print bars—3.2, 3.3, 3.4 and 3.5 in FIGS. 3; 4.2, 4.3, 4.4 and 4.5 in FIGS. 4; 5.2, 5.3, 5.4 and 5.5 in FIG. 5—for application of the ink or of the liquid toner as they may occur in typical print groups such as those above, connected to which printing devices are respective mechanisms 3.6; 4.6; 5.6 for heat treatment and fixing stations 3.7; 4.7; 5.7.

In FIG. 3, the mechanism 3.6 for heat treatment and the fixing station 3.7 are designed as infrared radiators, whereas in FIG. 4 the mechanism 4.6 for heat treatment and the fixing station 4.7 are designed as heating saddles, and in FIG. 5 the mechanism 5.6 for heat treatment and the fixing station 5.7 are designed as heated drums.

However, it is not precluded that an infrared radiator is used as a mechanism for heat treatment and a heating saddle or a heated drum is used in the or as the fixing station etc.

Figure 6:
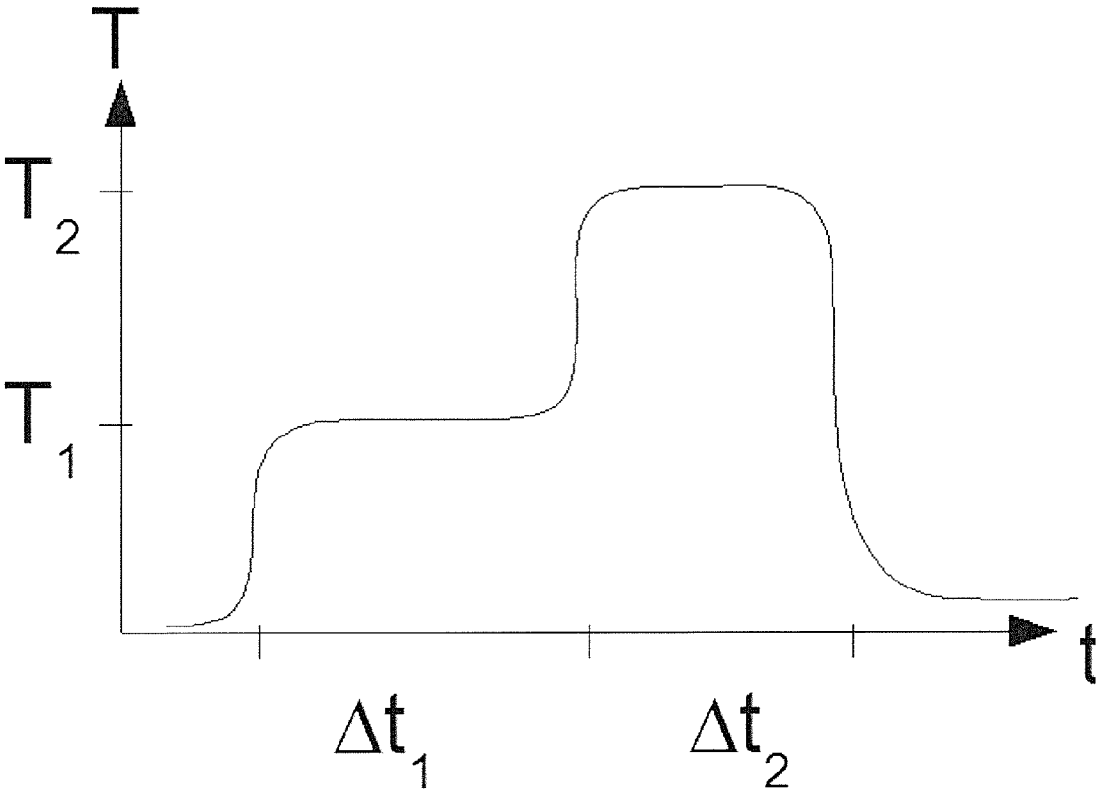
FIG. 6 an exemplary temperature curve in an example of a printing device according to the present disclosure.

An example temperature curve for a printed recording medium that is achievable in the embodiments presented in FIGS. 1 through 5 is shown in FIG. 6, wherein only the regions in the mechanism for heat treatment and the fixing station are depicted herein. After leaving the last printing device, the temperature is hereby increased from the ambient temperature or the temperature in the printing device to a defined temperature $T_1$ in the range from 40-80° C. in the mechanism for heat treatment, and is kept at this temperature $T_1$ for a duration $\Delta t_1$. The temperature is subsequently increased in the fixing station to a temperature $T_2$ and is kept at this for a duration $\Delta t_2$, which (as presented here) may be shorter than the duration $\Delta t_1$ but also may be longer. The temperature is subsequently decreased again to the ambient temperature of the printing device, but also may be decreased to another temperature. As presented in FIG. 6, the temperatures $T_1$ and $T_2$ may be kept approximately constant; however, a continuously rising or falling temperature gradient or a temperature gradient rising and falling in stages may also be provided, for example also using multiple mechanisms for heat treatment and/or multiple fixing stations.

Figure 7:
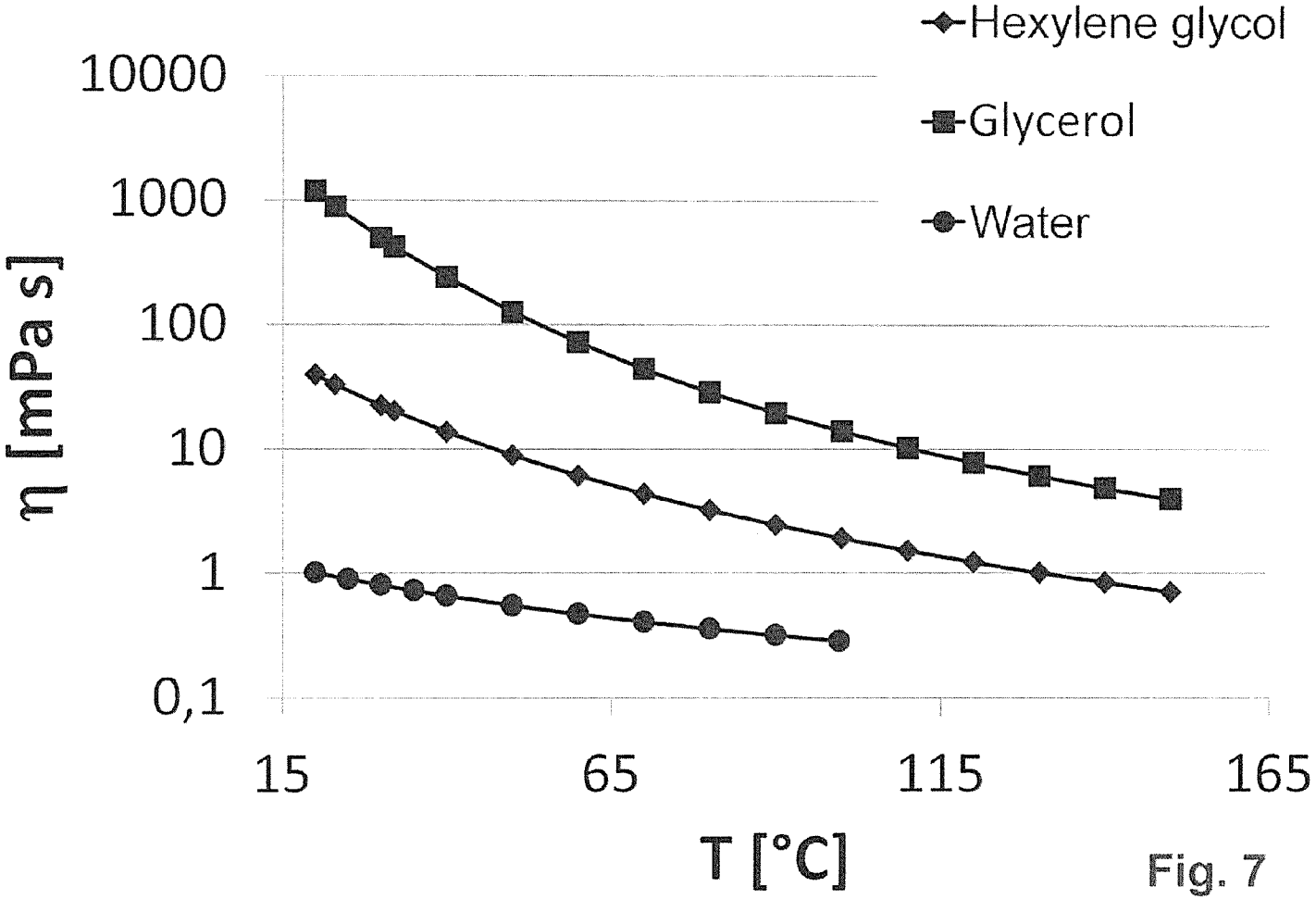
FIG. 7 examples of viscosity variations of selected solvents in an exemplary embodiment of the present disclosure.

As long as no noteworthy vaporization is still taking place, a decrease in the viscosity of fluids in the liquid component of an ink or of a liquid toner may be achieved via the heat treatment. Such a temperature-dependent decrease of the viscosity is depicted in FIG. 7 for example solvents, namely water, glycerol and hexylene glycol, which clearly arises from the Figure.

Figure 8:
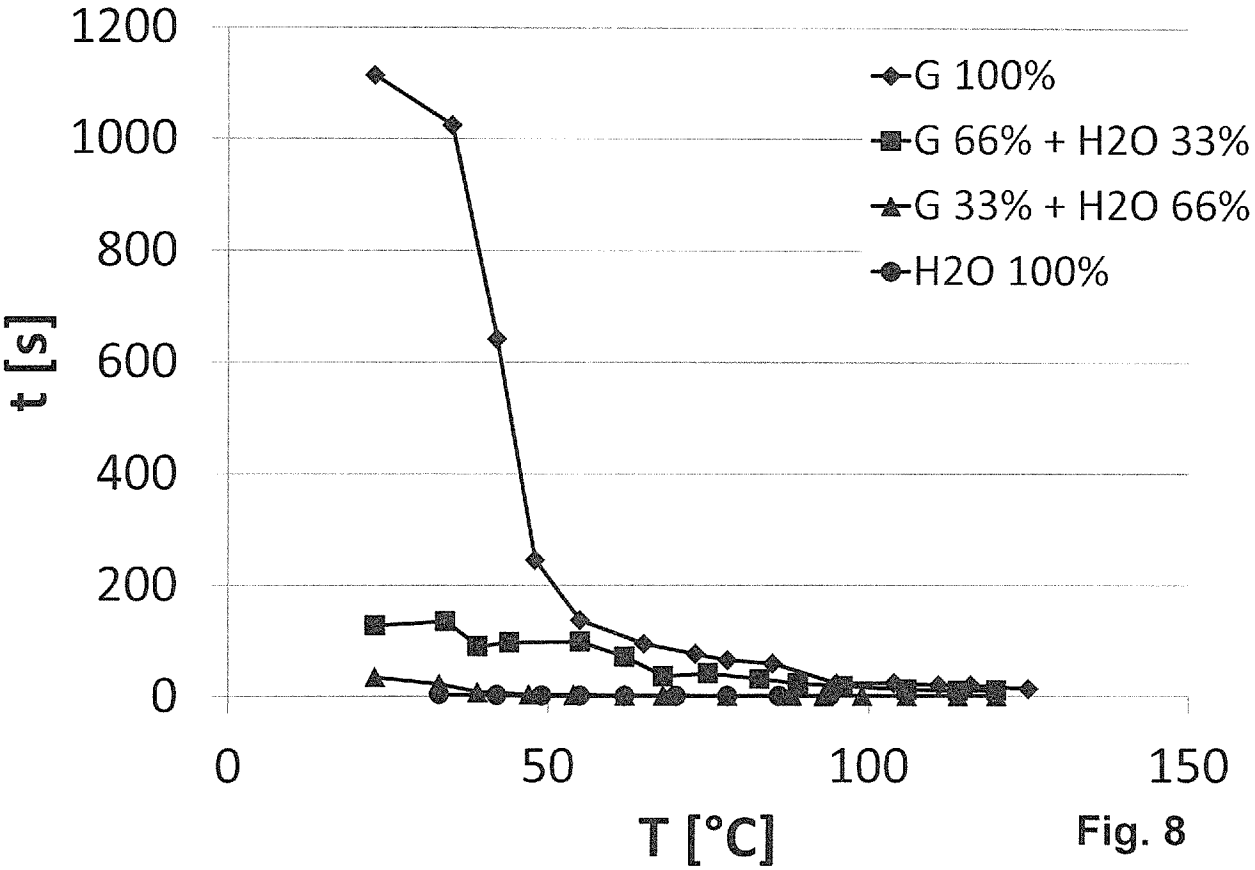
FIG. 8 example penetration times of various solvents into the example recording medium (paper).

The decrease of the viscosity of a fluid leads overall to a marked decrease of the viscosity for the liquid component of the ink or of the liquid toner, which leads to a reduction of the penetration time (duration) into a recording medium. This is depicted in FIG. 8 for examples of solvents or, respectively, solvent mixtures of glycerol G and water (H2O), wherein paper is used as a recording medium. In particular for glycerol G—but also for mixtures of glycerol G with water—a marked decrease of the penetration time in the range from 40 to 80° C. is to be observed, in particular at 50 to 75° C. A shorter duration for transition of fluids of the liquid component of the ink or, respectively, of the liquid toner into the recording medium may be achieved via this shortening of the penetration time, which leads to a reduction in size of the printing device (in particular the fixing station) and saves on costs, material and power.

As presented, in particular via mixing of organic solvents with water as fluids in the liquid component of an ink, a marked decrease in the viscosity may be achieved given a heat treatment, in particular if paper, paperboard or cardboard are used as recording media. For example, this may take place at approximately 70° C., such that water is not yet vaporized to a noteworthy extent but the viscosity of the liquid component or of the mixed fluids may be further reduced. The water may then be used as a transport medium, for example in order to transport organic solvents into the recording medium. Due to the increased temperature, the distance or duration in the printing device that is required for this may be minimized or it is possible for the first time to transport the solvents as completely as possible into the recording medium. Instead of water, a different solvent may also be used—for example an organic solvent such as Isopar™ N or Isopar™ M—with low viscosity (and if applicable low boiling point) that may easily be vaporized in the fixing station.

After the additional fluid (organic solvent, for example) is taken into the recording medium (such as paper) as completely as possible or completely, the temperature may be increased to over 90° C., for example over 100° C. or over 110° C., such that water or another fluid with low viscosity (for example less than 1.00 mPa·s) and if applicable low boiling point (in particular also with low boiling point, for example less than 110° C.) may be vaporized. In the event that thermoplastics are added, these may then form a closed film.

An example temperature and time progression in FIG. 7, with water as part of the liquid component, could hereby have a temperature of 70° C. as $T_1$ and a temperature above 100° C. as $T_2$, wherein in the time period $\Delta t_1$ the liquid portions of the ink penetrate into the recording medium (paper, for example), wherein water may also penetrate, and water is vaporized in the time period $\Delta t_2$ and a film of thermoplastics may form if applicable.

Via the present disclosure, the power required to fix the recording medium after printing via heat treatment before the fixing may be minimized, which leads to printing devices of reduced size with lower power consumption. A specially treated recording medium (such as specially treated paper) is hereby unnecessary, which additionally makes the printing more economical. Moreover, an improved print quality may be achieved, in particular with regard to the wear resistance of the printed recording medium.

Although preferred exemplary embodiments are shown and described in detail in the drawings and in the preceding specification, they should be viewed as purely exemplary and not as limiting the disclosure. It is noted that only preferred exemplary embodiments are shown and described, and all variations and modifications that presently or in the future lie within the protective scope of the disclosure should be protected.

REFERENCE LIST

3.2, 3.3, 3.4, 3.5 print head or print bar
4.2, 4.3, 4.4, 4.5 print head or print bar
5.2, 5.3, 5.4, 5.5 print head or print bar
3.6, 4.6, 5.6 mechanism for heat treatment
3.7, 4.7, 5.7 fixing station
10 digital printer
11, 11*a*-11*d* print group (front side)
12, 12*a*-12*d* print group (back side)
20 recording medium
20' print image (toner)
20" transport direction of the recording medium
21 roll (input)
22 take-off
23 conditioning group
24 turner
25 register
26 pulling group
27 take-up
28 roll (output)
30 fixer
40 climate controller
50 power supply
60 controller
70 fluid manager
71 fluid controller
72 reservoir
100 electrophotography station
101 photoconductor roller
102 erasure light
103 cleaner (photoconductor)
104 blade (photoconductor)
105 collection container (photoconductor)
105' arrow
106 charger (corotron)
106' wire
106" shield
107 air supply channel (aeration)
108 air supply channel (ventilation)
109 character generator
110 developer station
111 developer roller
112 reservoir chamber
112' fluid supply
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge

120 transfer station
121 transfer roller
122 cleaner (wet chamber)
123 cleaning brush (wet chamber)
123' cleaning fluid supply
124 cleaning roller (wet chamber)
124' cleaning fluid discharge
125 conditioner (retention plate)
126 counter-pressure roller
127 cleaning unit (counter-pressure roller)
128 collection container (counter-pressure roller)
128' fluid discharge
129 charger (corotron at transfer roller)

I claim:

1. A method for printing to a recording medium using at least one ink or at least one liquid toner whose liquid component comprises a plurality of fluids, the method comprising:

providing a printer configured to print to the recording medium;

providing a heater downstream of the printer in a printing direction;

providing a fixing station downstream of the heater in the printing direction;

after the printing by the printer, heat treating the recording medium in a range from 40 to 80° C. by the heater, wherein the liquid component comprises at least one first fluid and one second fluid, wherein the first fluid has a lower viscosity than the second fluid in the range from 40 to 80° C.; and thereafter fixing the recording medium at a temperature of at least 90° C. by the fixing station.

2. The method according to claim 1, wherein the liquid component comprises at least one organic solvent that is selected from the group of alcohols consisting of glycols, monoalcohols, pyrrolidones, and a mixture thereof.

3. The method according to claim 2, wherein the glycols consist of one or more of 2,2'-thiodiethanol, glycerol, 1,2-propylene glycol, 1,3-propylene glycol, 1,5-pentanediol, polyethylene glycol, ethylene glycol, diethylene glycol, propylene glycol, tetraethylene glycol and hexylene glycol, the monoalcohols consisting of one or more of n-propanol and isopropanol, and the pyrrolidones consist of one or more of 2-pyrrolidone, N-methyl-2-pyrrolidone and N-methyl-2-oxazolidinone.

4. The method according to claim 1, wherein the heat treatment is implemented for a duration of 0.01 to 20 s.

5. The method according to claim 1, wherein the heat treatment is implemented for a duration of 0.1 to 10 s.

6. The method according to claim 1, wherein the heat treatment is implemented for a duration of 1 to 5 s.

7. The method according claim 1, wherein the recording medium is a pulp-free recording medium, wherein the pulp-free recording medium comprises a porous structure.

8. The method according to claim 1, wherein the at least one ink or the at least one liquid toner additionally comprises at least one thermoplastic.

9. The method according to claim 8, wherein the thermoplastic is latex.

10. The method according to claim 1, wherein the heat treatment takes place at a substantially constant temperature.

11. The method according to claim 1, wherein the at least one heater is selected from a group consisting of infrared radiators, heating saddles and heated drums.

12. The method according to claim 1, wherein the at least one ink or the at least one liquid toner additionally comprises at least one surfactant substance.

13. The method according to claim 1, wherein the at least one ink comprises water.

14. The method according to claim 1, wherein the heater is provided completely downstream from the printer in the printing direction.

15. The method according to claim 1, wherein the heat treating the recording medium by the heater causes a viscosity of the liquid component to decrease.

16. A device for printing to a recording medium having at least one ink or at least one liquid toner whose liquid component has multiple fluids, comprising:

at least one printer for the ink or the liquid toner configured to print to the recording medium, wherein the ink or liquid toner is located on at least one side of the recording medium;

at least one heater downstream from the at least one printer in a printing direction, the at least one heater being configured to heat treat the printed recording medium in a range from 40 to 80° C., wherein the liquid component comprises at least one first fluid and one second fluid, wherein the first fluid has a lower viscosity than the second fluid in the range from 40 to 80° C.; and at least one fixing station downstream from the at least one heater in the printing direction, the at least one fixing station being configured to fix the recording medium in the printing direction after the heat treatment at a temperature of at least 90° C.

17. The device according to claim 16, wherein the at least one heater is configured to heat treat the printed recording medium essentially uniformly with heat.

18. The device according to claim 16, wherein the at least one heater is configured to heat treat the printed recording medium for a duration of 0.01 to 20 s.

19. The device according to claim 16, wherein the at least one heater is configured to heat treat the printed recording medium for a duration of 0.1 to 10 s.

20. The device according to claim 16, wherein the at least one heater is configured to heat treat the printed recording medium for a duration of 1 to 5 s.

21. The device according to claim 16, wherein the at least one heater is selected from the group of heaters consisting of: infrared radiators, heating saddles and heated drums.

22. The device according to claim 16, wherein the at least one heater is completely downstream from the at least one printer in the printing direction.

23. The device according to claim 16, wherein the heat treating the recording medium by the at least one heater causes a viscosity of the liquid component to decrease.

* * * * *